US006888514B2

(12) United States Patent
Sheng-Gen et al.

(10) Patent No.: US 6,888,514 B2
(45) Date of Patent: May 3, 2005

(54) ANTENNA WHICH CAN BE OPERATED IN A NUMBER OF FREQUENCY BANDS

(75) Inventors: Pan Sheng-Gen, Kamp-Lintfort (DE); Peter Nevermann, San Diego, CA (US)

(73) Assignee: Siemens Aktiengesellschaft, Munich (DE)

( * ) Notice: Subject to any disclaimer, the term of this patent is extended or adjusted under 35 U.S.C. 154(b) by 179 days.

(21) Appl. No.: 10/365,335

(22) Filed: Feb. 12, 2003

(65) Prior Publication Data

US 2003/0117340 A1 Jun. 26, 2003

Related U.S. Application Data

(63) Continuation of application No. 09/787,343, filed on Mar. 16, 2001, now Pat. No. 6,563,476.

(30) Foreign Application Priority Data

Sep. 16, 1998 (DE) ..... 198 42 449

(51) Int. Cl.[7] ..... H01Q 1/36; H01Q 1/32
(52) U.S. Cl. ..... 343/895; 343/715
(58) Field of Search ..... 343/893, 895, 343/900, 907, 908, 715

(56) References Cited

U.S. PATENT DOCUMENTS

| | | | | |
|---|---|---|---|---|
| 5,717,409 | A | 2/1998 | Garner et al. | 343/702 |
| 5,986,616 | A | 11/1999 | Edvardsson | 343/853 |
| 6,064,346 | A | 5/2000 | Blom | 343/895 |
| 6,069,592 | A | 5/2000 | Wass | 343/745 |
| 6,094,179 | A | 7/2000 | Davidson | 343/895 |
| 6,130,651 | A | 10/2000 | Yanagisawa et al. | 343/895 |
| 6,229,489 | B1 | 5/2001 | Holshouser et al. | 343/702 |
| 6,459,413 | B1 | 10/2002 | Tseng et al. | 343/702 |
| 6,459,916 | B1 | 10/2002 | Suguro | 455/575.7 |
| 6,642,893 | B1 | 11/2003 | Hebron et al. | 343/702 |

FOREIGN PATENT DOCUMENTS

| | | |
|---|---|---|
| EP | 0 522 806 B1 | 1/1993 |
| EP | 0 635 898 A1 | 1/1995 |
| EP | 0 814 536 A2 | 12/1997 |
| EP | 0 814 536 A3 | 12/1997 |
| WO | WO 95/08853 | 3/1995 |

*Primary Examiner*—Wilson Lee
*Assistant Examiner*—Minh Dieu A
(74) *Attorney, Agent, or Firm*—Bell Boyd & Lloyd LLC

(57) ABSTRACT

An antenna which can be operated in a number of frequency bands and has at least one part which encloses an area and at least one part which does not enclose an area, with the at least two parts including a single conductor part being connected in series with one another, and the at least two parts interacting with one another in such a manner that the antenna has at least two resonant frequencies in a definable position, and with each at the same time having a wide bandwidth.

38 Claims, 3 Drawing Sheets

ANTENNA WHICH CAN BE OPERATED IN A NUMBER OF FREQUENCY BANDS

This is a continuation of application Ser. No. 09/787,343 filed Mar. 16, 2001, now U.S. Pat. No. 6,563,476, incorporated in its entirety by reference.

BACKGROUND OF THE INVENTION

1. Field of the Invention

The present invention relates to an antenna which can be operated in a number of frequency bands, and which is preferably suitable for use in frequency bands for different Standards of mobile radio networks.

2. Description of the Prior Art

In recent years, mobile radio networks have been developed to different Standards which operate in different frequency bands. For example, the GSM Standard mobile radio network operates in the region around 900 MHz, the PCN Standard mobile radio network operates in the region around 1800 MHz, and the PCS Standard mobile radio network operates in the region around 1900 MHz. In this case, it should be noted that the frequency bands for the PCN and PCS Standards overlap one another.

It is, accordingly, desirable to produce mobile radio telephones or similar devices which can be operated in a number of different frequency bands; that is, which are able to work with different mobile radio network Standards. This requires the mobile radio telephones to have one or more antennas which also need to have different resonant frequencies. The resonant frequencies are, in this case, those for the espective frequency bands of the desired mobile radio networks. The reflection factor at these resonant frequencies must be as low as possible, and an adequate bandwidth also must be available to allow the mobile radio telephone to be operated in the respective frequency bands of the mobile radio networks to the various Standards.

A further major factor for the design of antennas for mobile radio networks is that the dimensions are subject to severe limitations for design reasons.

In previous antenna structures, which include a number of antennas, two helical antennas or other shapes such as meandering structures have been used; for example, for covering two different frequency bands. However, these solution approaches require more space than, for example, a simple helical antenna and/or their performance is poorer.

An antenna structure whose essential structure is illustrated schematically in FIG. 5 is known from EP-A-747990. This antenna structure has a first antenna element 10 and a second antenna element 20. The first antenna element 10 has a helical shape, and the second antenna element 20 is in the form of a straight rod or conductor. The two antenna elements 10 and 20 are connected to one another at a common feedpoint 30, and at least part of the second antenna element 20 is arranged inside the first antenna element 10.

In the antenna structure shown in FIG. 5, the first and second antenna elements 10 and 20, respectively, have different resonant frequencies to one another. Thus, the antenna structure shown in FIG. 5 can be operated in at least two frequency bands; for example, two frequency bands of mobile radio networks.

However, the already described antenna structure has considerable disadvantages. The mechanical design of the antenna structure is complex since the antenna structure includes a first and a second antenna element 10 and 20, respectively, with at least part of the second antenna element 20 being arranged inside the first antenna element 10. For this reason, a large amount of effort has to be accepted to manufacture the antenna structure.

Furthermore, the two antenna elements 10 and 20 are located physically close to one another which can lead to problems, such as a short-circuit. The antenna structure also has a narrow bandwidth in the region of one of the resonant frequencies, which can lead to problems during operation in certain mobile radio networks.

Finally, the antenna structure requires a matching network in order to achieve a matching to, normally, 50 Ω. Such a matching network causes losses in the system, however, owing to the components required for this network.

The present invention has been brought about as a result of the problems with the prior art which have been mentioned above, and its object, accordingly, is to provide an antenna which can be operated in a number of frequency bands, has a simple and low-cost structure and can be produced easily.

SUMMARY OF THE INVENTION

According to the present invention, therefore, an antenna which can be operated in a number of frequency bands has at least one part which encloses an area and at least one part which does not enclose an area. The at least two parts are composed of a single conductor part and are connected in series with one another. Furthermore, the at least two parts interact with one another in such a manner that the antenna has at least two resonant frequencies at a definable position, and with each at the same time having a wide bandwidth.

Since the two parts are composed of a single conductor part, only a single production process is required to manufacture the antenna, and an antenna with a simple and low-cost structure can be achieved.

According to an embodiment of the present invention, the antenna operates with a broad bandwidth close to a first resonant frequency in such a manner that it can be used in a first intended frequency band and operates with a wide bandwidth close to a second resonant frequency in such a manner that it can be used in two further intended frequency bands, and preferably has a characteristic impedance of 50 Ω in the intended frequency bands.

The resonant frequencies of the antenna likewise can be defined, while each at the same time having a wide bandwidth, in such a manner that the antenna can be used in the frequency bands of a number of mobile radio networks; for example, the GSM, PCN and PCS Standards.

Additional features and advantages of the present invention are described in, and will be apparent from, the following Detailed Description of the Preferred Embodiments and the Drawings.

DETAILED DESCRIPTION OF THE PREFERRED EMBODIMENTS

Figure 1:
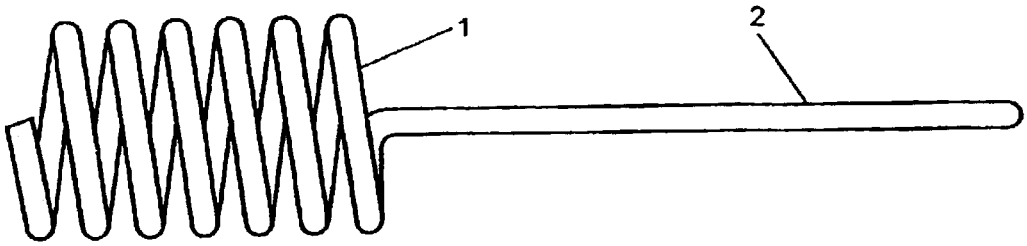
FIG. 1 shows an antenna which can be operated in a number of frequency bands, according to a first exemplary embodiment of the present invention.

FIG. 1 shows an antenna which can be operated in a number of frequency bands, according to the first exemplary embodiment of the present invention. As can be seen, the antenna has a first antenna element 1 and a second antenna element 2. In this exemplary embodiment of the present invention, the first antenna element 1 is in the form of a helix, and the second antenna element 2 is in the form of a straight rod. The two antenna elements 1 and 2 are composed of a single conductor part, for example, a wire. Furthermore, the two antenna elements are connected in series with one another and are physically arranged one behind the other.

The external dimensions of the overall antenna, which is shown in FIG. 1, correspond to those of a helical antenna designed for single-band operation.

Since the two antenna elements 1 and 2 are composed of a single conductor part, the antenna is simple and compact and, furthermore, can be manufactured in a single production process. In addition, the overall antenna can be produced with little financial outlay, since the antenna is composed of a single conductor part.

If each of the two antenna elements 1 and 2 are considered on their own, it can be seen that each of the antenna elements 1 and 2 has a number of different resonant frequencies.

However, the inventors of the present invention found that, by coupling the respective antenna elements 1 and 2, it is possible to adjust the position of the resonant frequencies of the resultant overall antenna over a wide range, with a wide bandwidth being achieved at the respective resonant frequencies.

The essential feature in this case is that the coupling of the first and second antenna elements 1 and 2 is designed in such a manner that the antenna can be used close to a first resonant frequency in one of the intended frequency bands, for example GSM or Global System for Mobile Communication around 900 MHz, and can operate close to a second resonant frequency with a wide bandwidth in such a manner that the antenna can be used in two further intended frequency bands, for example PCN, or the Personal Communication Network, around 1800 MHz, and the PCS, or Personal Communication System, around 1900 MHz.

Furthermore, this design may be implemented in such a manner that the antenna at the same time has a characteristic impedance of 50 Ω in the intended frequency bands. As a result, it is possible to operate the antenna without any matching network or with a small number of matching elements which, firstly, achieves a cost saving and, secondly, avoids losses which are caused by the components of the matching network in the system.

The previously mentioned coupling of the two antenna elements is, in this cases achieved as follows. The helical first antenna element 1 shown in FIG. 1 makes a major contribution to a low resonant frequency of the overall antenna, and the second antenna element 2, which is in the form of a rod, makes a major contribution to a high resonant frequency of the overall antenna, although the interaction between the two antenna elements 1 and 2 also must be taken into account. This means that the helical antenna element 1 contributes mainly to the setting of the resonant frequency for GSM operation around 900 MHz, and the antenna element which is in the form of a rod contributes mainly to the setting of the resonant frequency for PCN and PCS operation around 1800 and 1900 MHz, respectively. The antenna has a wide bandwidth at these two resonant frequencies, thus ensuring reliable operation in the respective frequency bands.

Figure 2:
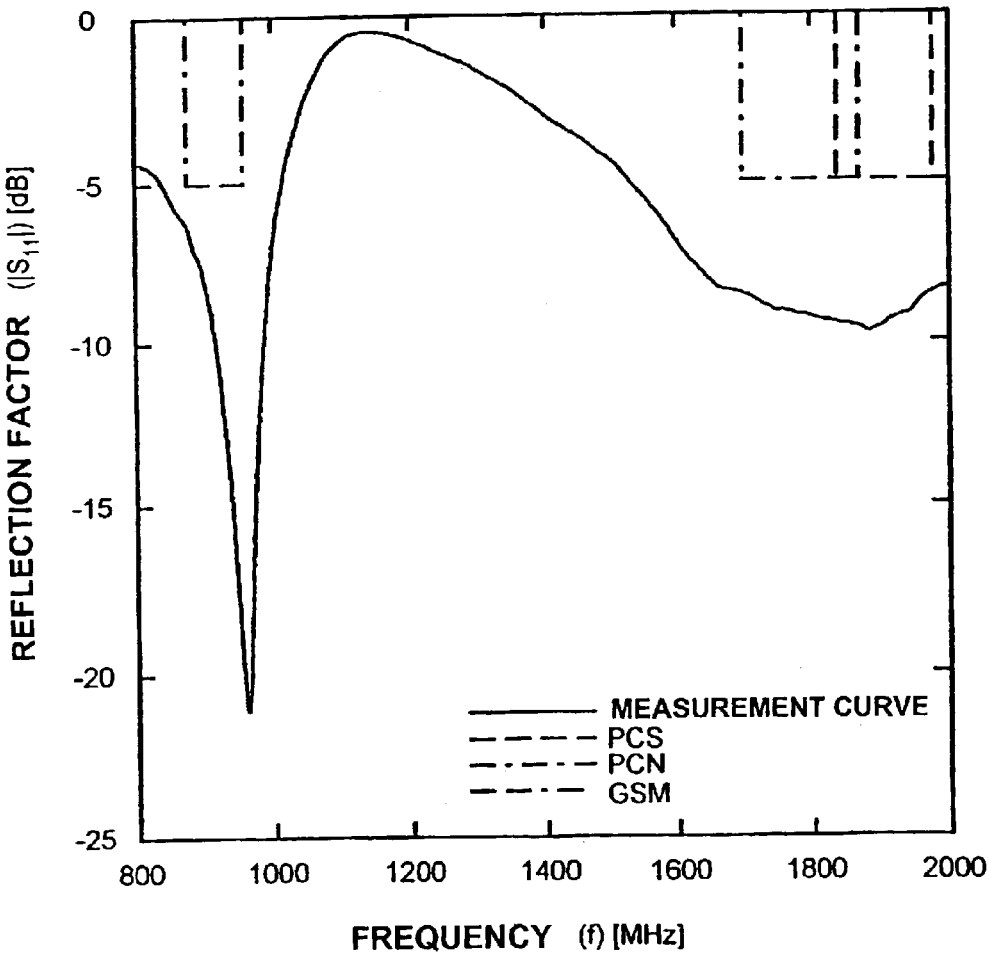
FIG. 2 shows a graph of the reflection factor plotted against the frequency for the antenna according to the first exemplary embodiment of the present invention.

FIG. 2 shows a graph which illustrates the reflection factor of an antenna the frequency, as has been determined by the inventors of the present invention with a the respective frequency bands of the GSM, PCS and PCN mobile radio networks are shown, for illustrative purposes, in the upper part of the graph.

It can thus be seen from FIG. 2 that the antenna has a first resonant frequency in the region of approximately 950 MHz with a bandwidth which is sufficient for operation in the GSM Standard mobile radio network, and has a second resonant frequency in the region around approximately 1850 MHz with a bandwidth which is sufficient for operation in both the PCS and PCN Standard mobile radio networks. Furthermore, it can be seen from FIG. 2 that the resonant frequencies of the antenna differ from one another by a factor of approximately 2, which means that the resonant frequencies of the antenna differ from one another to a major extent.

The statements which have already been made above with regard to the first exemplary embodiment of the present invention likewise apply to the second exemplary embodiment of the present invention, with the exception of the differences described below.

Figure 3:
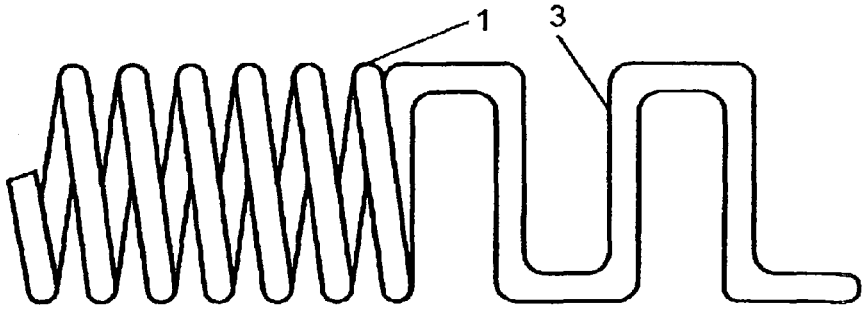
FIG. 3 shows an antenna which can be operated in a number of frequency bands, according to a second exemplary embodiment of the present invention.

FIG. 3 shows an antenna which can be operated in a number of frequency bands. As can be seen, the antenna according to the second exemplary embodiment of the present invention has a second antenna element 3 in the form of a rod which is bent in a meandering shape in a plane, rather than the second antenna element 2 in the form of a straight rod as in the first exemplary embodiment of the present invention.

The antenna shown in FIG. 3 results in the same advantages as those which have already been described in the description of the first exemplary embodiment of the present invention, so that their detailed description will be omitted at this point.

Figure 4:
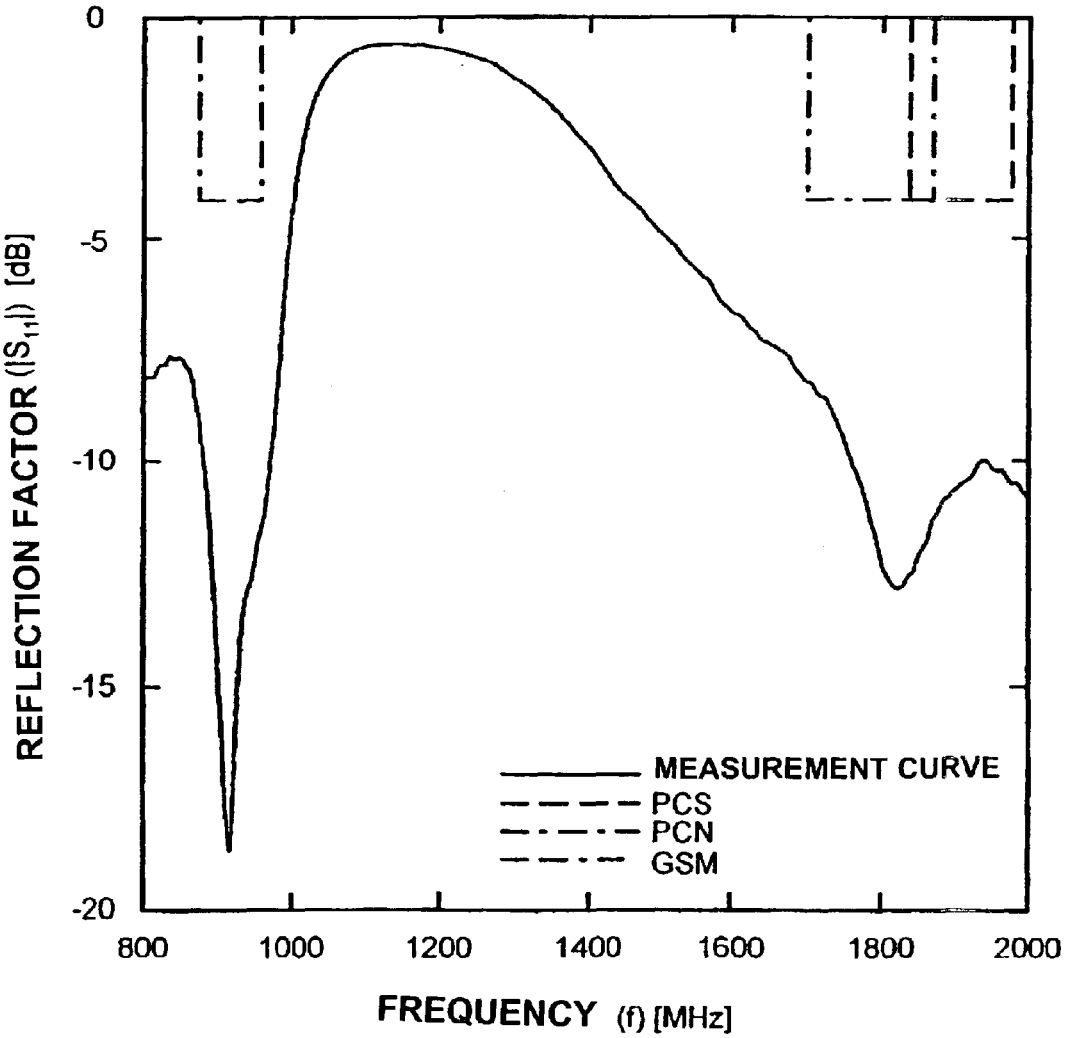
FIG. 4 shows a graph of the reflection factor plotted against the frequency for the antenna according to the second exemplary embodiment of the present invention.
Figure 5:
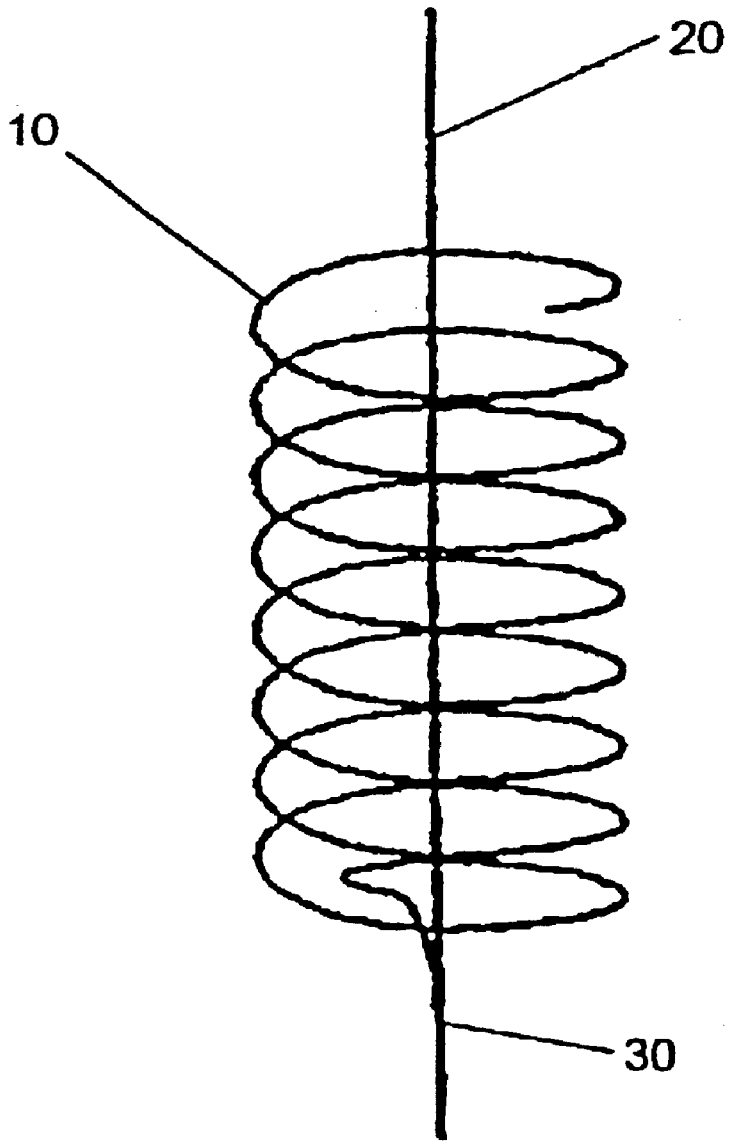
FIG. 5 PRIOR ART
FIG. 5 shows an antenna structure from the prior art.

FIG. 4 shows a graph which illustrates the reflection factor of an antenna according to the second exemplary embodiment of the present invention plotted against the frequency, as has been determined by the inventors of the present invention with an appropriate design of the coupling of the two antenna elements 1 and 3. Furthermore, the respective frequency bands for the GSM, PCS and PCN mobile radio networks are shown, by way of illustration, in the upper part of the graphs. It can thus be seen from FIG. 4 that the antenna has a first resonant frequency in the region around approximately 900 MHz, with a bandwidth which is sufficient for operation in the GSM Standard mobile radio network, and has a second resonant frequency in the region of around approximately 1800 MHz, with a bandwidth which is sufficient for operation in both the PCS and PCN Standard mobile radio networks.

Although the present invention has been explained with reference to the two exemplary embodiments described above, the present invention is not limited merely to these exemplary embodiments, as will be illustrated in more detail in the following text.

In the two already mentioned exemplary embodiments, the first antenna element is in the form of a helix. However, it is likewise possible for the first antenna element to be designed, for example, in the form of a coil section having a rectangular or triangular cross section. The essential feature is that the shape of the antenna element is selected in such a manner that the first antenna element encloses an area.

Furthermore, in the already mentioned exemplary embodiments of the present invention, the second antenna element is in the form of a straight rod or a rod which is bent in a meandering shape in a plane. However, it is likewise possible for the second antenna element to be designed, for example, in the form of a rod which is bent in a zig zag shape in a plane. The essential feature is that the second antenna element is selected in such a manner that the second antenna element does not enclose an area.

Further, according to the first and second exemplary embodiments of the present invention it has already been mentioned that the antenna includes only one first and one second antenna element. However, it is evident that, if desired, it is also possible to provide the first and second antenna elements in any desired combination. For example, a first antenna element could be designed in the form of a straight bar, a second antenna element in the form of a helix, and a further antenna element in the form a bar which is bent in a meandering shape in a plane, composed of a single conductor part. In general terms, accordingly, at least one part which encloses an area and at least one part which does not enclose an area must be provided, with these two parts being composed of a single conductor part.

Although the description of the first and second exemplary embodiments has stated that the coupling of the antenna elements is designed in such a manner that the antenna can be operated in the frequency bands of three different mobile radio network Standards, there is evidence that the coupling can be designed in such a manner that the antenna can be operated in frequency bands other than those described above, if this is desired for another application of the antenna.

In sum, although the present invention has been described with reference to specific embodiments, those of skill in the art will recognize that changes may be made thereto without departing from the spirit and scope of the invention as set forth in the hereafter appended claims.

We claim as our invention:

1. An antenna for operation in a plurality of predetermined frequency bands, comprising:

at least one first part which encloses an area; and at least one second part which does not enclose an area;

wherein the at least one first part and the at least one second part are coupled together in series with one another, and wherein the at least one first part and the at least one second part are so configured and arranged that the antenna has at least first and second resonant frequencies within the plurality of predetermined frequency bands, the at least one first part substantially defining the first resonant frequency and the at least one second part substantially defining the second resonant frequency.

2. An antenna for operation in a plurality of predetermined frequency bands as claimed in claim 1, wherein the antenna operates with a wide bandwidth close to the first resonant frequency for use in a first intended frequency band and operates with a wide bandwidth close to the second resonant frequency for use in two further intended frequency bands.

3. An antenna for operation in a plurality of predetermined frequency bands as claimed in claim 2, wherein the antenna has a characteristic impedance of approximately 50 ohms in the intended frequency bands.

4. An antenna for operation in a plurality of predetermined frequency bands as claimed in claim 1, wherein the at least one first part has a helical shape.

5. An antenna for operation in a plurality of predetermined frequency bands as claimed in claim 1, wherein the at least one second part is in the form of a rod.

6. An antenna for operation in a plurality of predetermined frequency bands as claimed in claim 1, wherein the at least one second part is in the form of a rod which is bent in a meandering shape in a plane.

7. An antenna for operation in a plurality of predetermined frequency bands as claimed in claim 1, wherein the at least one first part and the at least one second part are physically positioned one behind the other.

8. An antenna for operation in a plurality of predetermined frequency bands as claimed in claim 1, wherein the at least one first part has a lower resonant frequency than the at least one second part.

9. An antenna for operation in a plurality of predetermined frequency bands as claimed in claim 1, wherein the at least first and second resonant frequencies of the antenna are defined such that the antenna is operable in frequency bands of a plurality of mobile radio networks.

10. An antenna for operation in a plurality of predetermined frequency bands as claimed in claim 9, wherein the frequency bands of the plurality of mobile radio networks include those associated with the GSM, PCN and PCS standards.

11. An antenna for operation in a plurality of predetermined frequency bands as claimed in claim 10, wherein a resonant frequency of the antenna in the frequency band of the GSM standard is achieved primarily by the at least one first part, and a resonant frequency of the antenna in the frequency bands of the PCN and PCS standards is achieved primarily by the at least one second part.

12. An antenna for operation in a plurality of predetermined frequency bands as claimed in claim 1, wherein the at least one first part and the at least one second part are formed of a single conductor part.

13. An antenna for operation in a plurality of predetermined frequency bands as claimed in claim 1, wherein first and second resonant frequencies of the at least two resonant frequencies each has a wide bandwidth.

14. A multi-frequency band antenna for operation in a plurality of predetermined frequency bands, comprising:

a first antenna element defining a three-dimensional shape; and a second antenna element defining one of a linear shape and a two-dimensional shape, and electrically connected to the first antenna element in series;

the first and second antenna elements so configured and arranged to define at least first and second resonant frequencies within the plurality of predetermined frequency bands, the first antenna element substantially defining the first resonant frequency and the second antenna element substantially defining the second resonant frequency.

15. A multi-frequency band antenna according to claim 14, wherein the first resonant frequency is within a first frequency band of the plurality of predetermined frequency bands, and wherein the second resonant frequency is within second and third frequency bands of the plurality of predetermined frequency bands.

16. A multi-frequency band antenna accordingly to claim 15, wherein the antenna has an impedance of approximately 50 ohms in the first, second, and third frequency bands.

17. A multi-frequency band antenna according to claim 14, wherein the first antenna element has a helical shape.

18. A multi-frequency band antenna according to claim 14, wherein the second antenna element is in the form of a rod.

19. A multi-frequency band antenna according to claim 14, wherein the second antenna element has a meandering shape.

20. A multi-frequency band antenna according to claim 14, wherein the first and second antenna elements are positioned directly one behind the other.

21. A multi-frequency band antenna according to claim 14, wherein the first antenna element has a lower resonant frequency than the second antenna element.

22. A multi-frequency band antenna according to claim 14, wherein the at least first and second resonant frequencies are defined such that the antenna is operable in frequency bands of a plurality of mobile radio networks.

23. A multi-frequency band antenna according to claim 22, wherein the frequency bands of the plurality of mobile radio networks comprise the GSM, PCN and PCS standards.

24. A multi-frequency band antenna according to claim 23, wherein a resonant frequency of the antenna in the frequency band of GSM standard is achieved primarily by the first antenna element, and a resonant frequency of the antenna in the frequency bands of PCN and PCS standards is achieved primarily by the second antenna element.

25. A multi-frequency band antenna according to claim 14, wherein the first and second antenna elements are formed of a single conductor part.

26. A multi-frequency band antenna according to claim 14, wherein the at least first and second resonant frequencies each has wide bandwidth.

27. A multi-frequency band antenna according to claim 14, wherein the first and second antenna elements are so configured and arranged to define the first resonant frequency as from about 900 MHz to about 1,000 MHz, and the second resonant frequency as from about 1,800 MHz to about 1,900 MHz.

28. A method of making an antenna, comprising the steps of:

providing a first antenna element having a three-dimensional shape in series with a second antenna element which does not have a three-dimensional shape; and constructing the first and second antenna elements such that the antenna has at least first and second different predetermined resonant frequencies in which the first antenna element substantially defines the first resonant frequency and the second antenna element substantially defines the second resonant frequency.

29. A method of making an antenna according to claim 28, further comprising the step of forming the first and second antenna elements from a single conductor.

30. A method of making an antenna according to claim 28, further comprising the step of forming the second antenna element in a linear shape.

31. A method of making an antenna according to claim 28, further comprising the step of forming the second antenna element in a planer shape.

32. A method of making an antenna according to claim 31, further comprising the step of forming the second antenna element in a meandering shape.

33. A method of making an antenna according to claim 28, wherein the constructing step further comprises the step of providing the antenna with the first resonant frequency of from about 900 MHz to about 1,000 MHz, and the second resonant frequency of from about 1,800 MHz to about 1,900 MHz.

34. A method of operating an antenna, comprising the steps of:

a) providing first and second antenna elements connected together in series;

b) allowing the first and second antenna elements to cooperatively resonant within a first frequency band substantially defined by the first antenna element; and c) allowing the first and second antenna elements to cooperatively resonant within a second frequency band substantially defined by the second antenna element and different from the first frequency band.

35. The method of operating an antenna according to claim 34, wherein step (b) further comprises the step of allowing the antenna to resonant at a frequency of from about 900 MHz to about 1,000 MHz.

36. The method of operating an antenna according to claim 35, wherein step (c) further comprises the step of allowing the antenna to resonant at a frequency of from about 1,800 MHz to about 1,900 MHz.

37. The method of operating an antenna according to claim 36, wherein step (a) further comprises the steps of:

providing the first antenna element with a three-dimensional shape; and providing the second antenna element with a linear shape.

38. The method of operating an antenna according to claim 36, wherein step (a) further comprises the steps of:

providing the first antenna element with a three-dimensional shape; and providing the second antenna element with a meandering shape.

* * * * *